US008177917B2

(12) United States Patent
Lindros

(10) Patent No.: US 8,177,917 B2
(45) Date of Patent: May 15, 2012

(54) CLEANING ASSEMBLY

(75) Inventor: Aleksander Lindros, Copenhagen (DK)

(73) Assignee: Alfa Laval Tank Equipment A/S, Ishoj (DK)

( * ) Notice: Subject to any disclaimer, the term of this patent is extended or adjusted under 35 U.S.C. 154(b) by 497 days.

(21) Appl. No.: 12/097,005

(22) PCT Filed: Jan. 30, 2007

(86) PCT No.: PCT/DK2007/000043

§ 371 (c)(1),
(2), (4) Date: Oct. 20, 2008

(87) PCT Pub. No.: WO2007/090395

PCT Pub. Date: Aug. 16, 2007

(65) Prior Publication Data

US 2009/0260661 A1 Oct. 22, 2009

(30) Foreign Application Priority Data

Feb. 8, 2006 (DK) ..... 2006 00176

(51) Int. Cl.
*B08B 9/00* (2006.01)
*B08B 3/00* (2006.01)

(52) U.S. Cl. ..... 134/167 R; 134/176

(58) Field of Classification Search ..... 134/167 R
See application file for complete search history.

(56) References Cited

U.S. PATENT DOCUMENTS

| | | | | |
|---|---|---|---|---|
| 5,333,630 | A | 8/1994 | Jepsen et al. | |
| 6,460,553 | B1 * | 10/2002 | Owens et al. | 134/167 R |
| 2004/0238009 | A1 * | 12/2004 | Falster-Hansen et al. | 134/22.1 |

FOREIGN PATENT DOCUMENTS

| | | | |
|---|---|---|---|
| EP | 0027007 | A | 4/1981 |
| EP | 0247532 | A | 12/1987 |
| JP | 03-169511 | A | 7/1991 |
| JP | 08-010734 | A | 1/1996 |
| WO | WO92/04994 | A | 3/1992 |
| WO | WO00/20134 | A | 1/2004 |

OTHER PUBLICATIONS

Machine translation of EP 0247532 (Dec. 1987).*
International Search Report.

* cited by examiner

*Primary Examiner* — Michael Barr
*Assistant Examiner* — Jason Ko
(74) *Attorney, Agent, or Firm* — Fish & Richardson P.C.

(57) ABSTRACT

To achieve complete cleaning of a tank (11) by means of a cleaning head (4, 5) having nozzles (6) mounted on a liquid supply pipe (3), the cleaning head (4) according to the invention is provided with one or more nozzle openings, nozzles (7), which eject a jet/jets (8, 9) against the supply pipe/suspension (3). This ensures that the stationary parts of the cleaning equipment (3, 10) are cleaned effectively during the turning (4*a*) of the cleaning head (4) and thereby of the nozzle/nozzles (7).

6 Claims, 1 Drawing Sheet

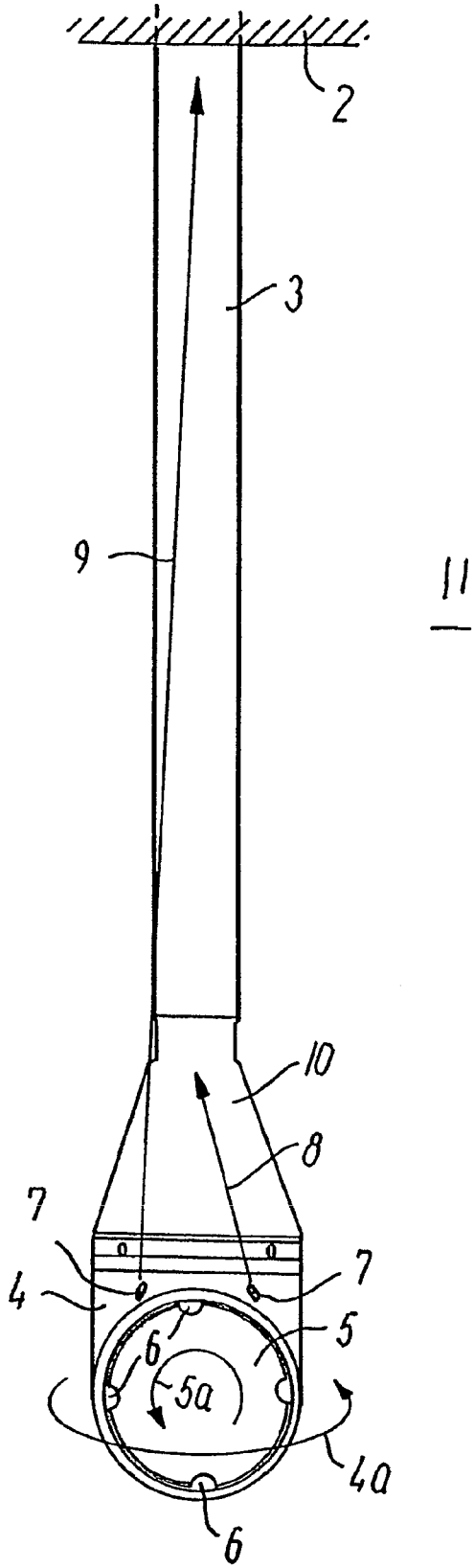
2
3
9
11
10
8
7
7
4
5
6
5a
4a
6

CLEANING ASSEMBLY

THE PRIOR ART

The invention relates to a cleaning assembly, in particular to be mounted internally in a tank, said assembly comprising a cleaning housing mounted on a liquid supply pipe and having means for turning the housing at the same time as a hub having nozzles is rotated, and wherein one or more nozzle openings are provided on the turnable part of the housing, said nozzles ejecting a liquid jet against the supply pipe for the cleaning of it during the turning movement.

Assemblies of this type are widely used for the cleaning of tanks of any type in that nozzles eject cleaning liquid in a so-called cleaning pattern during the combined turning and rotation, such that the tank is cleaned effectively.

However, there is a need for also ensuring that the combined suspension and liquid supply system, too, is cleaned effectively.

Increasing hygiene requirements, particularly in the food processing and medicinal industries, make it necessary to ensure that everything in the tank, including the assembly, etc., is cleaned completely during the actual cleaning process.

The Patent Application US 2003/0145880 A1 discloses a solution, where the outer surfaces of the cleaning assembly itself are flushed by cleaning liquid in order to satisfy the hygiene requirements in the food processing and medicinal industries.

Some narrow openings are provided where the liquid supply pipe is introduced through the top of the tank, allowing cleaning liquid to seep down over the liquid supply pipe. Further, a nozzle is arranged in the introduction area at the top of the tank for the supply of cleaning liquid under pressure to the outer side of the liquid supply pipe. The nozzle is directed inwards toward the pipe close to the top of the tank, so that the cleaning liquid can dissolve any impurities and flow down the pipe.

However, it has been found that the cleaning effect of this solution is not as complete as is required, because the liquid jet from the nozzle or from the mentioned narrow openings for cleaning liquid cannot get into the corners in the area of the top of the tank where the liquid supply pipe is introduced.

In addition, the proposal provides no solution as to how to ensure that the cleaning head is cleaned sufficiently.

Another patent DK 171410 B1 discloses a proposal as to how the cleaning head itself may be cleaned by flushing it with cleaning liquid. Here, the gaps occurring between the fixed part and the turnable part of the cleaning head and between the hub and the turnable part of the housing, are used for ejecting cleaning liquid over the outer surface of the cleaning head. Moreover, the hub is provided with a baffle which is capable of directing the rotating cleaning jet from the gaps of the hub against the surfaces of the cleaning head. As the cleaning jets are ejected at the same time as the housing turns and the hub rotates, the entire surface of the housing is thus reached.

However, the patent provides no solution as to how the supply pipe and its introduction area through the top of the tank is cleaned.

In the patent EP0247532 by Becker a cleaning assembly is described, where an extra nozzle is placed on the housing. This should aid in the cleaning of the cleaning assembly.

THE OBJECT OF THE INVENTION

The object of the invention is to provide an assembly to satisfy these requirements of total cleaning, and this is achieved according to the invention in that the nozzle or nozzles are provided on the side of the housing which faces toward the rotating hub.

It is ensured in this surprisingly simple manner that the parts of the assembly which are disposed above the turnable and rotating parts of the cleaning head are cleaned effectively at the same time as the other parts, i.e. tank and cleaning head, are cleaned in one and the same operation.

A liquid film is hereby produced on the surface, which cleans the external surface of the equipment.

When the nozzle or the nozzles are provided on the part of the turnable head which points toward the rotating hub having the nozzles, these additional nozzles may be configured as channels between the inner liquid space and the surface of the housing.

It is expedient, in some embodiments, that the jets may be adjusted so as to allow flushing, as needed, of the pipe member and the stationary part of the housing.

THE DRAWING

An example of an embodiment of the assembly according to the invention will be described more fully below with reference to the drawing, which shows an assembly mounted in a tank.

DESCRIPTION OF AN EXEMPLARY EMBODIMENT

The drawing shows a cleaning assembly mounted on a stay or a pipe 3, which extends from the tank wall 2 and a suitable distance into the tank 11.

The cleaning head itself is mounted at the end of the pipe 3 in the form of a stationary hub cone 10, in which the drive motor is present.

This motor is constructed as a liquid-driven rotor which, via a gear, partly turns the housing 4 as indicated by an arrow 4*a*, partly the hub 5 which is caused to rotate as indicated by an arrow 5*a*.

In the example shown, the rotary hub 5 has mounted thereon four nozzles 6 through which the flushing water is ejected during the combined turning 4*a* and rotation 5*a*.

According to the invention, one or more additional nozzles 7 are provided in the turnable housing 4 in the form of either bores to create nozzle openings or by means of nozzles screwed into it. These nozzles are oriented such that during the turning 4*a* of the housing 4 they eject one or more liquid jets upwards for the cleaning of the stationary parts, such as the hub cone 10 and the pipe 3.

As indicated by arrows 8 and 9, the jet/jets is/are adapted to sweep the parts in such a manner that all areas are cleaned thoroughly during the turning 4*a*, and a liquid film is produced on the surface.

The nozzle or nozzles 7 receive pressure liquid from the interior of the housing 4, and this liquid also drives the motor and is conveyed to the cleaning nozzles 6.

Hereby, both the tank 11 and the cleaning equipment 3, 10 as well as the cleaning head 4 and 5 itself are cleaned effectively upon supply of pressure liquid to the equipment.

The used cleaning liquid is sucked out from the tank in a generally known manner by means of a discharge device (not shown).

Instead of the cleaning head shown and described, the invention may also be performed on a cleaning head which is driven by a motor and a gear spaced from the cleaning head itself, e.g. in that the driving equipment is mounted externally on the tank.

The invention claimed is:

1. A cleaning assembly comprising:

a hub cone mounted on a liquid supply pipe;

a cleaning housing mounted on the hub cone;

means for turning the cleaning housing relative to the hub cone about a first axis at the same time as a hub having nozzles is rotated about a second axis that is substantially perpendicular to the first axis; and one or more nozzles or nozzle openings on a part of the cleaning housing that is turnable about the first axis, wherein the one or more nozzles or nozzle openings on the part of the cleaning housing that is turnable about the first axis comprise one or more nozzles or nozzle openings configured to eject a liquid jet against the supply pipe for cleaning the supply pipe during the turning movement of the cleaning housing, and wherein the one or more nozzles or nozzle openings on the part of the cleaning housing that is turnable about the first axis are on a side of the cleaning housing which faces the rotating hub.

2. A cleaning assembly according to claim 1, wherein the one or more nozzles or nozzle openings are configured such that the jets are directed toward various points on the hub cone or the supply pipe, or toward various points on both the hub cone and the supply pipe.

3. A cleaning assembly according to claim 1 wherein the one or more nozzles or nozzle openings on the part of the cleaning housing that is turnable about the first axis are configured to eject fluid in a substantially upward direction toward the liquid supply pipe or the hub cone.

4. A cleaning assembly comprising:

a hub cone configured for mounting to an end of a liquid supply pipe;

a cleaning housing coupled to the hub cone, wherein the cleaning housing is configured to turn relative to the hub cone about a first axis;

a hub coupled to the cleaning housing, wherein the hub is configured to rotate about a second axis that is substantially perpendicular to the first axis;

hub nozzles on the hub, wherein each hub nozzle is configured to eject fluid during operation of the cleaning assembly;

one or more nozzles on the cleaning housing that are configured to eject one or more liquid jets against the liquid supply pipe or the hub cone for cleaning the liquid supply pipe or the hub cone during operation of the cleaning assembly; and a drive motor configured to turn the cleaning housing about the first axis and to rotate the hub about the second axis.

5. A cleaning assembly according to claim 4 wherein the one or more nozzles on the cleaning housing are on a side of the cleaning housing that faces the hub.

6. A cleaning assembly according to claim 4, wherein the one or more nozzles on the cleaning housing are configured such that the one or more liquid jets are directed toward one or more points on the hub or the supply pipe.

* * * * *

UNITED STATES PATENT AND TRADEMARK OFFICE

CERTIFICATE OF CORRECTION

PATENT NO. : 8,177,917 B2
APPLICATION NO. : 12/097005
DATED : May 15, 2012
INVENTOR(S) : Lindros It is certified that error appears in the above-identified patent and that said Letters Patent is hereby corrected as shown below:

On the Title page, Item (30) (Foreign Application Priority Data), Line 1, delete "2006 00176" and insert --PA 2006 00176--.

Signed and Sealed this
Tenth Day of July, 2012

David J. Kappos

David J. Kappos
*Director of the United States Patent and Trademark Office*